United States Patent [19]

Kimbara et al.

[11] 4,402,348

[45] Sep. 6, 1983

[54] APPARATUS FOR REGULATING TENSION IN WARPS OF A WEAVING MACHINE

[75] Inventors: Masahiko Kimbara; Noboru Kobayashi, both of Kariya, Japan

[73] Assignee: Kabushiki Kaisha Toyoda Jidoshokki Seisakusho, Aichi, Japan

[21] Appl. No.: 252,042

[22] Filed: Apr. 8, 1981

[30] Foreign Application Priority Data

Apr. 12, 1980 [JP] Japan ..... 55-48209

[51] Int. Cl.[3] ..... D03D 49/06

[52] U.S. Cl. ..... 139/110; 139/115

[58] Field of Search ..... 139/110, 109, 103, 114, 139/115, 97; 66/211, 213; 242/75.5

[56] References Cited

U.S. PATENT DOCUMENTS 813,833 2/1906 Ryder ..... 139/115
1,612,051 12/1926 Quig ..... 139/109
3,255,784 6/1966 Rothfuss et al. ..... 139/110

FOREIGN PATENT DOCUMENTS 25326 12/1883 Fed. Rep. of Germany ..... 139/110
48-23108 7/1973 Japan ..... 139/110

*Primary Examiner*—James Kee Chi
*Attorney, Agent, or Firm*—Burgess, Ryan and Wayne

[57] ABSTRACT

An apparatus for regulating tension in warps of a weaving machine comprising: a tension lever swingably supported on a weaving machine and having a roller supported thereon for regulating the tension in warps delivered from a warp beam; a weight lever swingably supported on the weaving machine and having a load at one end thereof; and a link operatively connecting the tension lever and the weight lever. The tension lever has an elongated hole formed thereon, and the lever ratio of the tension lever is changed by moving the link along the elongated hole.

13 Claims, 10 Drawing Figures

APPARATUS FOR REGULATING TENSION IN WARPS OF A WEAVING MACHINE

FIELD TO WHICH THE PRESENT INVENTION RELATES

The present invention relates to an apparatus for regulating tension in warps of a weaving machine, such as a power loom, an air jet loom or a water jet loom, which is conventionally well known.

BACKGROUND OF THE INVENTION

In a weaving machine, warps delivered from a warp beam are fed to heddles through a plurality of rollers, such as a back roller and a tension roller. Conventionally an apparatus for regulating tension in warps is widely utilized for regulating the tension in the warps in accordance with, for example, the type of the woven fabric so that woven fabrics having a ground weave and hand which are in demand as manufactured fabrics can be manufactured. A so called weight lever type tension regulating apparatus has been commonly utilized. The apparatus comprises a tension lever for supporting a tension roller; and a loading means, such as a weight or a spring, connected to said tension lever in order to create a desired tension in warps by displacing said tension roller.

However, such a conventional apparatus has a disadvantage in that the adjusting of the loading means based on the kind of warps or the type of the woven fabrics is troublesome. Accordingly, the weaving operation is often adversely affected because of unsatisfactory adjustment of the loading means, such as a weight or a spring. More specifically, if the tension in warps created by the loading means is small, the response of the regulating apparatus becomes slow. Contrary to this, if the tension in warps created by the loading means is large, the response of the regulating apparatus becomes excessively high and adversely affects the weaving operation.

SUMMARY OF THE INVENTION

An object of the present invention is to provide an apparatus for regulating tension in warps, by which the disadvantage involved in the adjustment of the loading means of the conventional apparatus can be eliminated.

Another object of the present invention is to provide an apparatus for regulating tension in warps, which is provided with a means for varying a lever ratio and by which the tension in warps can easily be adjusted in a wide range without changing the load of the loading means.

BRIEF DESCRIPTION OF THE ATTACHED DRAWINGS

A conventional apparatus and some embodiments of the present invention will now be explained in detail with reference to the attached drawings, wherein.

DETAILED DESCRIPTION OF THE INVENTION

Figure 1:
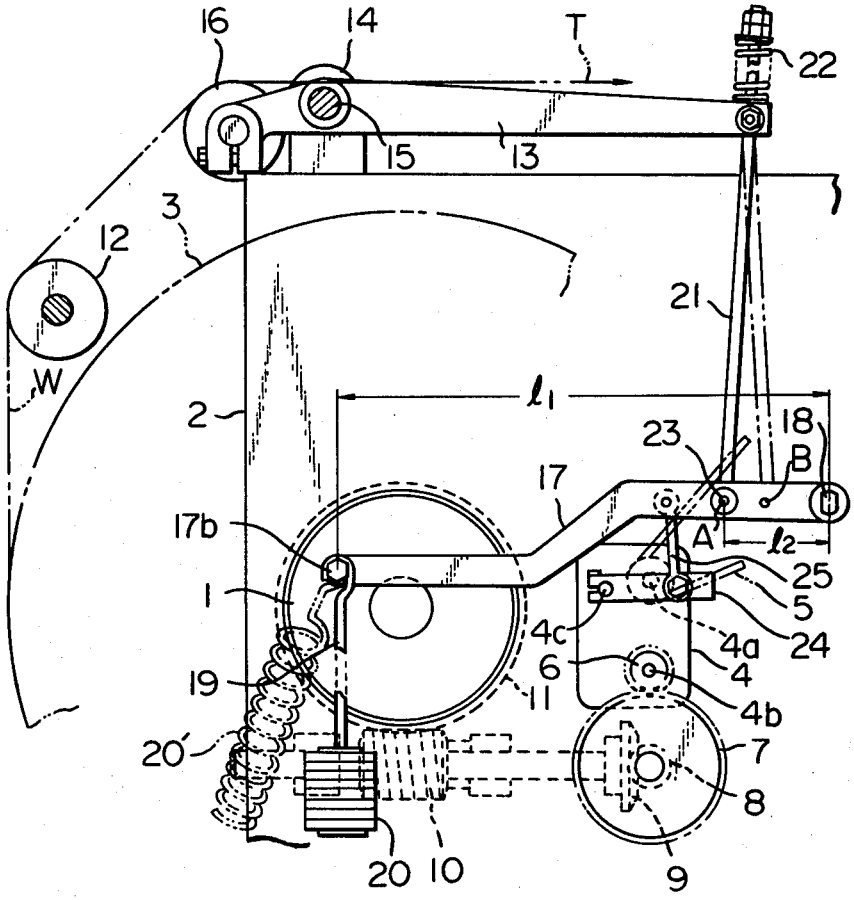
Fig. 1 PRIOR ART
FIG. 1 is a side view of a conventional apparatus for regulating tension in warps.

A conventional weight lever type apparatus for regulating tension in warps will now be explained first with reference to FIG. 1. In FIG. 1, 1 denotes a shaft of a warp beam which is rotatably supported on a machine frame 2 of a weaving machine and which detachably supports a warp beam 3 between the shaft 1 and the side of the machine frame 2 facing the shaft 1. Reference numeral 4 denotes a speed change device disposed on one side of the machine frame 2. The speed change device 4 has: an input shaft **4*a* driven by a conventional drive shaft (not shown) of the weaving machine, via a toothed belt 5; and an output shaft 4*b* transmitting the output power which is obtained by changing the speed by means of the speed change device 4. The output shaft 4*b* has a pinion 6 attached thereto which engages with a spur gear 7. A bevel gear 8 coaxial with the spur gear 7 engages with another bevel gear 9 which is coaxial with a worm 10 meshing with a worm wheel 11 attached to one end of the shaft 1 of the warp beam. Accordingly, the output power of the speed change device 4 is transmitted to the shaft 1 of the warp beam through the pinion 6, the spur gear 7, the bevel gears 8 and 9, the worm 10 and the worm wheel 11. As a result, the warp beam 3** is positively rotated in synchronization with the shedding operation of the weaving machine as the drive shaft rotates.

Reference numeral 12 denotes a back roller which is rotatably supported between the left ends of the machine frame 2 at a location above the warp beam 3 and which guides warps W delivered from the warp beam 3.

Reference numeral 13 denotes tension levers (only one of which is illustrated in FIG. 1) rotatably supported by means of a shaft 15 on a pair of support mounts 14 fixed on both sides of the machine frame 2. A roller 16 for regulating tension in warps is rotatably supported between the rear ends of the tension levers 13. As a result of the above-explained construction, warps W delivered inclinedly and upwardly from the warp beam 3 through the back roller 12 are fed to heddles (not shown) through the tension roller 16. The change in tensions in warps is detected by the tilting movement of the tension lever 13 caused by the vertical movement of the tension roller 16.

Reference numeral 17 denotes a weight lever swingably supported on the machine frame 2 by means of a shaft 18. The weight lever 17 has a pin **17*b* secured to the left end thereof which serves to hang down a hanging hook 19 with balance weights 20 or to connect a tension spring 20' which is illustrated by a dot and dash line in FIG. 1. A connecting rod 21 has: a compression spring 22 at the upper end thereof for connecting to the right end of the tension lever 13; and a connecting pin 23 at the lower end thereof for connecting to the portion adjacent to the right end of the weight lever 17. As a result of this construction, as the tilting movement of the tension lever 13 caused by the change in tension in warps, the weight lever 17 is also tilted by means of the connecting rod 21**.

A speed change lever 24 connected to a speed change shaft **4*c* of the speed change device 24 is connected to the weight lever 17 by way of a synchronizing link 25, so that the reduction ratio of the speed change device 4 is varied in accordance with the tilting movement of the weight lever 17 caused by the change in tension in warps, and so that the rotational speed during unwinding operation of the warp beam 3** is controlled in order to maintain an adquate tension in warps regardless of the change in tension.

In the conventional apparatus for regulating tension in warps explained above, the tension T being exerted on the warps W is balanced with the weight 20 or the spring 20'. Accordingly, theoretically the adjustment of the tension T in warps upon, for example, the change of the type of woven fabric can be carried out by changing the total weight of the weight 20 or the spring force exerted by a spring 20'. However, in actual fact, if the tension T in warps is excessively small because of an excessively light weight, the response of the lever mechanism for actuating the tension roller 16, the mechanism comprising the tension lever 13 and the connecting rod 21, becomes slow. Accordingly, the speed change operation of the speed change device 4 cannot smoothly be done. As a result, there occurs a disadvantage in that the weaving operation is adversely affected.

Contrary to this, if the tension W in warps is excessively large due to the heavy weight 20, the response of the lever mechanism for actuating the tension roller 16 becomes too fast to stably effect the speed change operation of the speed change device 4. As a result, there occurs a similar disadvantage in that the weaving operation is also adversely affected.

To obviate the above-explained disadvantages, the above-explained conventional apparatus for regulating tension in warps has a specially designed construction by which the degree of the response of the lever mechanism is varied in accordance with change in tension T in warps W. More specifically, the location of the connecting pin 23 connecting the weight lever 17 and the connecting rod 21 is varied so that the ratio of the distance $l_1$ between the shaft 18 and the working point of the weight 20 to the distance $l_2$ between the shaft 18 and the connecting pin 23 (which ratio $l_1/l_2$ is referred to as a lever ratio of the weight lever 17) is varied and so that the degree of response is adjusted. When the tension T in warps W is small, the connecting pin 23 is located at a position A in FIG. 1, so that the lever ratio of the weight lever 17 is decreased, and so that the degree of the response is enhanced. When the tension T in warps W is large, the connecting pin 23 is moved to position B in FIG. 1, so that the lever ratio of the weight lever 17 is increased, and so that the degree of the response is decreased. As a result, the weaving operation is intended to be stably carried out regardless of the change in tension T in warps T.

Figure 2:
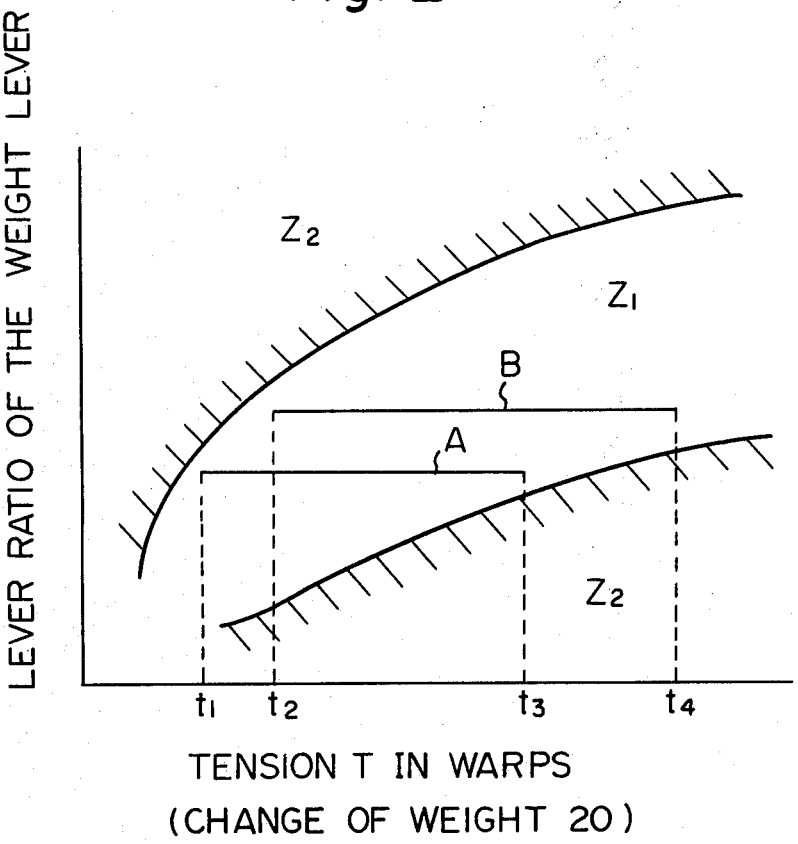
Fig. 2 PRIOR ART
FIG. 2 is a diagram illustrating a warp tension controlling property of the apparatus illustrated in FIG. 1.

Incidentally, according to experimental tests concerning weaving operation, based on the tension T in warps W, i.e., the amount of the weight 20, and the lever ratio of the weight lever 17, the stably operative region $Z_1$ and the unstable and inoperative region $Z_2$ can be determined as illustrated in FIG. 2. In addition, the lines A and B in FIG. 2 also illustrate the maximum ranges of tension T in warps W, in which ranges the weaving operation can stably done, when the connecting pin 23 is located at positions A and B in FIG. 1. As is obvious from FIG. 2, in order to stably adjust the tension T in warps W in a wide range, it is desirable that the location of the connecting pin 23 is varied so that the lever ratio of the weight lever 17 is varied. However, in either case A or B in FIG. 2, the maximum range between $t_1$ and $t_2$, or $t_3$ and $t_4$ of the tension T in warps W is narrow. Furthermore, the adjustment of the weight 20 or the spring 20' (FIG. 1) is unavoidable and is troublesome.

As described above, one of the objects of the present invention is to provide an apparatus for regulating tension in warps, which is provided with a means for varying the lever ratio so that the tension in warps can easily be adjusted in a wide range without changing the weight or spring force.

An embodiment of the present invention will now be explained with reference to FIGS. 3 and 4.

Figure 3:
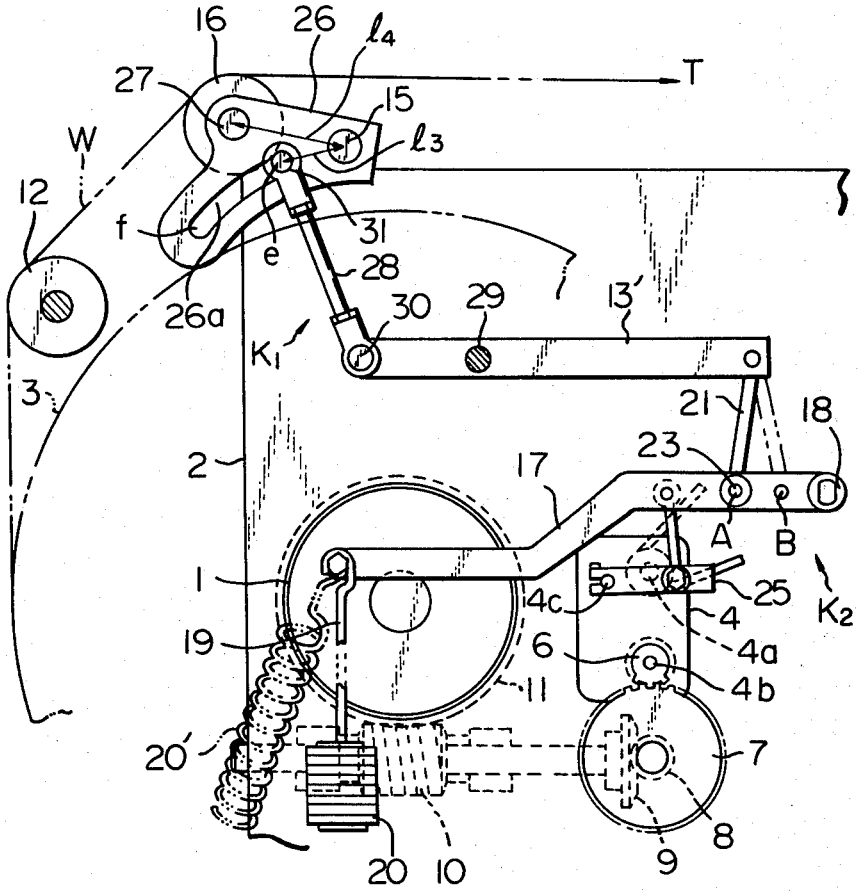
FIG. 3 is a side view of an apparatus for regulating tension in warps of the present invention.
Figure 4:
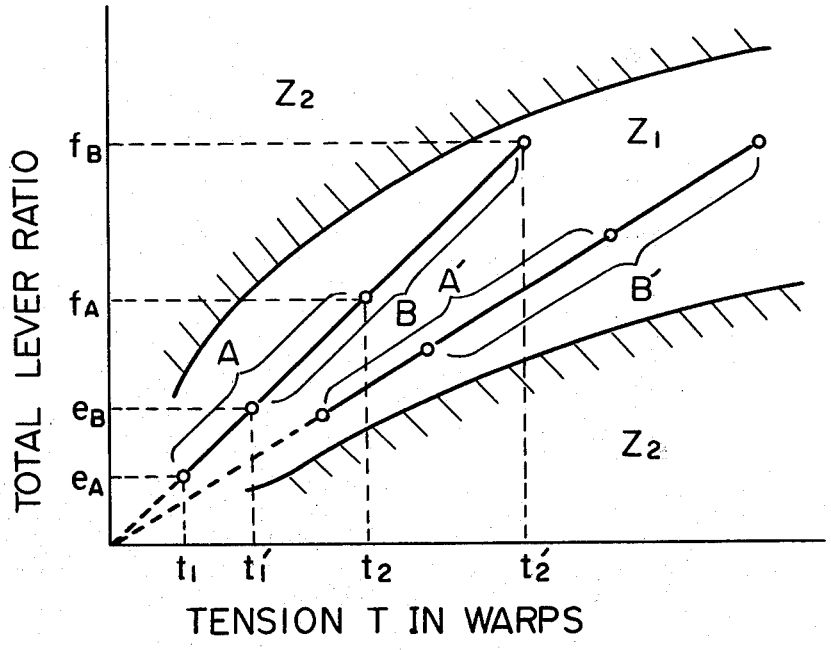
FIG. 4 is a diagram illustrating a warp tension controlling property of the apparatus illustrated in FIG. 3.

In FIG. 3, the parts which have constructions and functions similar to those of the conventional apparatus illustrated in FIG. 1 are denoted by the same reference numerals as those in FIG. 1, and their further explanation is omitted. Reference numeral 26 denotes a pair of tension levers, (only one of which is illustrated in FIG. 3) which have a tension roller 16 rotatably supported therebetween by means of a shaft 27. The tension levers 26 have circular arc-shaped elongated holes formed therein. An intermediate lever 13' is located beneath the tension lever 26 and is swingably supported by means of a shaft 29. The lower end of an adjusting link 28 is connected to the left end of the intermediate lever 13'. A connecting pin 31 is connected to the upper end of the adjusting link 28 and is pivotally connected to the elongated hole **26*a* in such a manner that the connecting pin 31 is movable along the elongated hole 26*a*. When the location of the connecting pin 31 is adjusted between the ends e and f of the elongated holes 26*a*, the ratio of the distance $l_3$ between the shaft 15 of the tension lever 26 and the connecting pin 31 to the distance $l_4$ between the shaft 15 and the shaft 27 of the tension roller 16** can be varied. The ratio $l_3/l_4$ is referred to as a lever ratio of the tension lever.

The apparatus for regulating tension in warps constructed in such a manner as explained above operates as follows. The solid lines in FIG. 3 illustrate a condition wherein the connecting pin 31 of the adjusting link 28 is located at one end of the elongated hole **26*a* near the shaft 15 so that the lever ratio of the tension lever 26 is minimum, and wherein the connecting pin 23 of the connecting rod 21 is located at position A far from the shaft 18 so that the lever ratio of the weight lever is also minimum. The lever ratio $e_A$ from the weight lever to the tension lever and the tension $t_1$ in warps W are illustrated in the lower left corner of FIG. 4. When the location of the connecting pin 31 is moved from position e to position f along the elongated hole 26*a* in FIG. 3 while the weight 20 or the spring 20' is maintained constant, the moment exerted on the tension lever 26 caused by the weight 20 through the weight lever 17 and the adjusting link 28 is increased due to the change of the lever ratio of the tension lever. As a result, the tension T in warps W is increased from $t_1$ to $t_2$ along line A as illustrated in FIG. 4** while the weight is unchanged.

When the connecting rod 23 illustrated in FIG. 3 is moved from position A to position B, the lever ratio of the weight lever is increased, and accordingly, the tension T in the warps W is increased. As the connecting pin 31 together with the adjusting link 28 is moved along the elongated hole **26*a*** from one end e to the other end f, the total lever ratio is changed from $e_B$ to $f_B$ and the tension T in the warps W is increased from $t_1'$ to $t_2'$. Therefore, the tension can be adjusted in a wide range.

When enlargement of the tension adjusting region is required, while a heavier weight 20 is used and the connecting pin 23 is located at position A, the adjusting link 28 is moved along the elongated hole 26*a* from one end e to the other end f. As a result, the tension T in the warps W is varied as illustrated by A′ while the heavier weight 20 is unchanged. When the adjusting link 28 is moved along the elongated hole 26*a* from one end e to the other end f after the connecting pin 23 is moved to position B, the tension T in the warps W is varied as illustrated by B′ while the heavier weight 20 is unchanged.

As explained above, since in this apparatus, the adjusting link 28 which is capable of adjustment of the lever ratio of the tension lever 26 is disposed between the tension lever 26 and the intermediate lever 13′, the tension T in warps can stably be adjusted in a wide range compared with the conventional apparatus for regulating tension in a warps while the weight 20 is unchanged. In addition, the tension in warps can easily be adjusted by a simple operation wherein the position of the adjusting link 28 is varied.

Please note that, although the weight 20 is changed at two stages in the above-explained embodiment so that the tension T in warps is varied in a remarkably wide range, the weight 20 does not drop if the weight 20 is fixed to the hanging hook 19 once the weight 20 is changed.

The present invention can actually be constructed in the following embodiments.

Figure 5:
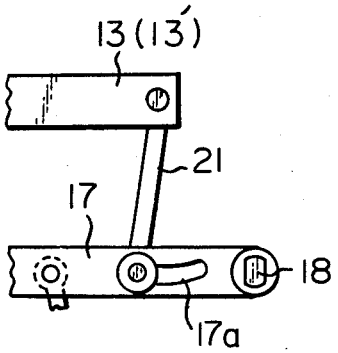
FIGS. 5 through 10 are partial side views of other embodiments of the present invention.

(1) In an embodiment illustrated in FIG. 5, a weight lever 17 has a circular arc shaped elongated hole 17*a* formed terein. The upper end of a connecting rod 21 is pivoted to the right end of a tension lever 13 in an apparatus constructed in such a manner similar to that illustrated in FIG. 1 or the right end of an intermediate lever 13′ in an apparatus constructed in such a manner similar to that illustrated in FIG. 3. The lower end of the connecting rod is pivoted to the weight lever 17 in such a manner that it is movable along the elongated hole 17*a*.

Figure 6:
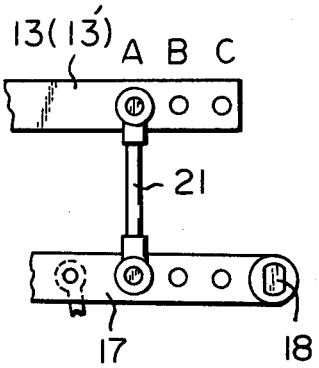

(2) In another embodiment illustrated in FIG. 6, a tension lever 13 in an apparatus constructed in such a manner similar to that illustrated in FIG. 1 or an intermediate lever 13′ in an apparatus constructed in such a manner similar to that illustrated in FIG. 3 is used. The tension lever 13 or 13′ has a plurality of holes at positions A, B and C formed therein. The weight lever 17 similarly has a plurality of holes at positions A, B and C formed therein. The upper and lower ends of a connecting rod 21 are selectively connected to the holes so that the lever ratio can be varied.

Figure 7:
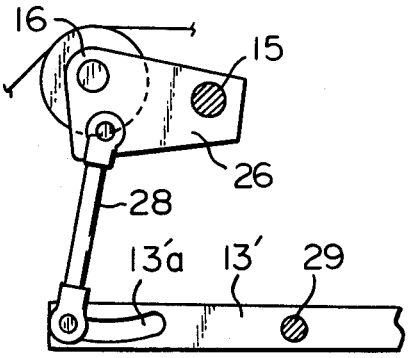

(3) In a further embodiment illustrated in FIG. 7, an intermediate lever 13′ has a circular arc shaped elongated hole 13′*a* formed at the front end thereof. The lower end of the adjusting link 28 connected to a tension lever 26 is connected to the elongated hole 13′*a* in such a manner that the position of the adjusting lever 28 can be adjusted along the elongated hole 13′*a*.

Figure 8:
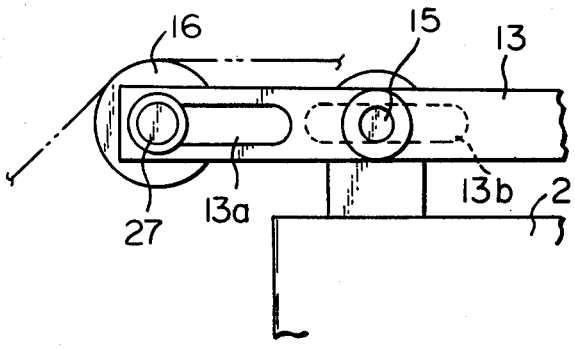

(4) In a still further embodiment illustrated in FIG. 8, a pair of tension levers 13, (only one of which illustrated in FIG. 8) have straight elongated holes 13*a* formed at the left ends thereof. A shaft 27 of a tension roller 16 is engaged with and secured to the elongated holes 13*a* in such a manner that the position of the tension roller 16 is adjustable along the elongated holes 13*a*. Instead of the elongated holes 13*a*, a pair of elongated holes 13*b* may be formed on the tension levers 13 as illustrated by a broken line, so that the tension levers 13 are swingably supported by a shaft 15 in such a manner that the fulcrum of the tension levers 13 can be varied along the elongated holes 13*b*.

Figure 9:
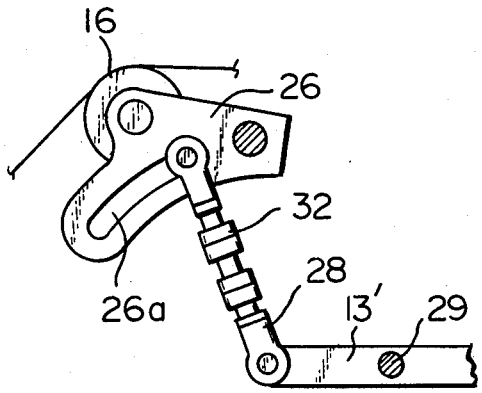

(5) In a further embodiment illustrated in FIG. 9, which is constructed in a manner similar to that of FIG. 3, an adjusting link 28 has a pair of turn buckles connected therein so that the length of the adjusting link 28 is adjustable.

Figure 10:
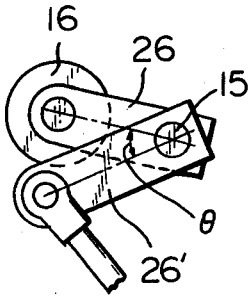

(6) In a still further embodiment illustrated in FIG. 10, the tension lever, for example, illustrated in FIG. 3, is divided into two pieces 26 and 26′, and the angle $\theta$ formed between the pieces 26 and 26′ is adjustable.

As explained above, the present invention is provided with a means for varying a lever ratio of a tension control system between a weight lever and a tension lever which means is operatively coupled to the tension control system including a roller for regulating tension in warps delivered from a warp beam, the tension in warps can easily and stably be adjusted in a wide range only by the operation of the means for varying the lever ratio while the weight is unchanged.

We claim:

1. An apparatus for regulating tension in warps of a weaving machine comprising: a tension lever swingably supported on said weaving machine and having a roller supported thereon for regulating the tension in warps delivered from a warp beam; a weight lever swingably supported on said weaving machine and having a load at one end thereof; a means for positively driving said warp beam operatively connected to said weight levers and a line means operatively connecting said tension lever and said weight lever, characterized in that a means for varying a lever ratio is disposed in a system between said weight lever and said tension lever.

2. An apparatus according to claim 1, wherein said lever ratio varying means takes at least three different lever ratios.

3. An apparatus according to claim 1, wherein said tension lever has an elongated hole formed therein, and said lever ratio varying means includes said link means, one end of which is connected to said elongated hole in such a manner that the connecting position is adjustable along said elongated hole.

4. An apparatus according to claim 1, which further comprises an intermediate lever swingably supported on said weaving machine, one end of said intermediate lever being operatively connected to said tension lever by means of a first link, the other end of said intermediate lever being operatively connected to said weight lever by means of a second link, and said lever ratio varying means comprises at least a link means, at least an end of which is fixedly positioned in engagement with an elongated hole, the position of said end being adjustable along said elongated hole.

5. An apparatus according to claim 4, wherein said tension lever has an elongated hole formed therein, and one end of said first link is connected to said elongated hole to form said lever ratio varying means in such a manner that the connecting position is adjustable along said elongated hole.

6. An apparatus according to claim 4, wherein said intermediate lever has an elongated hole formed therein, and one end of said first link is connected to said elongated hole to form said lever ratio varying means in such a manner that the connecting position is adjustable along said elongated hole.

7. An apparatus according to claim 5 or 6, wherein said first link further comprises a turn-buckle arranged therein so that the length thereof is adjustable.

8. An apparatus according to claim 1, wherein said weight lever has an elongated hole formed therein, and said lever ratio varying means is composed of said link means, one end of which is operatively connected to said elongated hole in such a manner that the connecting position is adjustable along said elongated hole and the other of which is operatively connected to said tension lever.

9. An apparatus according to claim 1, wherein said weight lever and said tension lever have a plurality of holes formed therein, respectively, and said lever ratio varying means is composed of said link means, one of which is operatively connected to one of said holes formed on said weight lever, and the other of which is operatively connected to one of said holes formed on said tension lever.

10. An apparatus according to claim 1, wherein said lever ratio varying means comprises said tension lever which has an elongated hole formed therein and which is swingably supported by means of a pin after the position of said lever is adjusted along said elongated hole.

11. An apparatus according to claim 1, wherein said lever ratio varying means is an additional lever, one end of which is operatively connected to said link means and which is constructed in such a manner that the angle formed between said tension lever and said additional lever can be varied.

12. An apparatus according to claim 1, wherein said load is a balance weight attached to said weight lever.

13. An apparatus according to claim 1, wherein said load is a spring connected to said weight lever.

* * * * *